US007320200B1

(12) United States Patent
Eisner

(10) Patent No.: US 7,320,200 B1
(45) Date of Patent: Jan. 22, 2008

(54) MULTIPLEX HOUSING WITH CENTRAL AND PERIPHERAL DWELLING UNITS

(76) Inventor: Richard S. Eisner, 11605 Pawnee La., Leawood, KS (US) 66211

( * ) Notice: Subject to any disclaimer, the term of this patent is extended or adjusted under 35 U.S.C. 154(b) by 68 days.

(21) Appl. No.: 10/908,997

(22) Filed: Jun. 3, 2005

(51) Int. Cl.
*E04H 1/00* (2006.01)

(52) U.S. Cl. ..... 52/236.1; 52/79.4; D25/4

(58) Field of Classification Search ..... 52/236.1, 52/236.2, 79.4, 79.7, 79.8; D25/4
See application file for complete search history.

(56) References Cited

U.S. PATENT DOCUMENTS

| | | | | | |
|---|---|---|---|---|---|
| 1,464,189 | A | * | 8/1923 | Simonson | 52/236.3 |
| 3,479,781 | A | * | 11/1969 | Wallace | 52/169.3 |
| D216,954 | S | * | 3/1970 | Jenn | D25/4 |
| D222,343 | S | * | 10/1971 | Mullen | D25/4 |
| D223,485 | S | * | 4/1972 | Mullen | D25/4 |
| D229,925 | S | * | 1/1974 | Hurwitz | D25/22 |
| D229,926 | S | * | 1/1974 | Hurwitz | D25/22 |
| 4,007,565 | A | * | 2/1977 | Finnegan | 52/169.3 |
| 4,041,661 | A | * | 8/1977 | Hurwitz | 52/169.4 |
| 4,232,490 | A | * | 11/1980 | Doane | 52/167.1 |
| 4,345,407 | A | * | 8/1982 | Fishman | 52/169.3 |
| D273,228 | S | * | 3/1984 | Cotton | D25/1 |
| 4,685,260 | A | * | 8/1987 | Jenn | 52/169.3 |
| 4,800,692 | A | * | 1/1989 | Jenn | 52/169.2 |
| 4,920,711 | A | * | 5/1990 | Mitchell, Sr. | 52/169.2 |
| D315,023 | S | * | 2/1991 | Jenn | D25/17 |
| 6,182,408 | B1 | * | 2/2001 | Poehler | 52/234 |
| 6,470,633 | B2 | * | 10/2002 | Showen | 52/169.1 |
| 6,550,197 | B1 | * | 4/2003 | Gray | 52/236.3 |
| 2004/0006940 | A1 | * | 1/2004 | Gray | 52/236.3 |
| 2005/0198915 | A1 | * | 9/2005 | Walters | 52/71 |

* cited by examiner

*Primary Examiner*—Richard E. Chilcot
*Assistant Examiner*—Gay Ann Spahn
(74) *Attorney, Agent, or Firm*—Hovey Williams LLP

(57) ABSTRACT

A land use-efficient multiplex housing structure (10) is provided having a central housing unit (12) of generally cruciform plan configuration, with a plurality (preferably four) of peripheral dwelling units (14,16,18,20) interconnected with and spaced about the central unit (12). Each peripheral unit (14,16,18,20) preferably has a generally quadrate primary dwelling area (96,134,172,212) and an associated elongated extension section (84,124,162,202) which extends toward and is interconnected with a respective wall portion of central dwelling unit (12).

17 Claims, 3 Drawing Sheets

MULTIPLEX HOUSING WITH CENTRAL AND PERIPHERAL DWELLING UNITS

BACKGROUND OF THE INVENTION

1. Field of the Invention

The present invention is broadly concerned with improved multiplex common wall housing structures and designs which couple efficient land use together with maximum privacy for each of the individual dwelling units forming a part of the multiplex. More particularly, the invention is especially concerned with five-plex dwelling structures including a central dwelling unit and a plurality of peripheral units located in a "spoke" orientation relative to the central dwelling unit.

2. Description of the Prior Art

Multiple-unit housing structures have been built in various ways and designs for literally thousands of years. Modern-day multiplex housing begins with conventional duplex houses and extends to high-rise apartment buildings. Moreover, there is an increasing tendency towards building of free-standing multiplex housing structures having from three to six individual housing units therein, particularly in new, master planned communities.

In designing and developing multiplex housing units, a number of competing considerations come into play. Thus, there is a need to design the structures using the least possible land, and to make use of standard designs and in some cases prefabricated components, in order to minimize costs. However, home buyers traditionally are interested in customizable floor plans and a maximum of dwelling privacy. Thus, it is a relatively straightforward matter to maximize the number of housing units per given land area with identical housing unit designs, but such cost control efforts tend to be in conflict with privacy and variable design concerns of the individual home buyers.

SUMMARY OF THE INVENTION

The present invention overcomes the problems outlined above and provides a unique manner of reconciling the seemingly contradictory considerations of cost and land use efficiency together with providing customizable housing units affording a high degree of dwelling privacy for the individual occupants of the units. To this end, a multiplex housing structure constructed in accordance with the principles of the present invention preferably includes a central dwelling unit presenting defining outer walls, and at least four peripheral dwelling units disposed about said central dwelling unit. Each peripheral dwelling unit has walls defining a primary dwelling area and an elongated dwelling section projecting from the primary dwelling area. Each of the elongated dwelling sections presents an end remote from the corresponding primary dwelling section, with the end being adjacent a respective outer wall of the central dwelling unit. Thus, the design provides an efficient "spoke" orientation of the peripheral dwelling units about the central dwelling unit.

Preferably the "spoke" housing units are designed such that each has at least three exterior walls which are orthogonal relative to each other.

A second aspect of the present invention concerns a multiplex housing structure comprising five individual, interconnected dwelling units and five individual garages. Each of the garages is associated with a respective one of the dwelling units. Moreover, the garages of the housing structure face in at least three separate directions.

In further preferred forms, the individual dwelling units are covered by a common roof and a garage is provided for each dwelling unit. Advantageously, four of the five garages in a five-plex structure are respectively located between the central dwelling unit and one of the peripheral dwellings. The fifth garage is located between a pair of adjacent elongated dwelling sections.

Other aspects and advantages of the present invention will be apparent from the following detailed description of the preferred embodiments and the accompanying drawing figures.

BRIEF DESCRIPTION OF THE DRAWING

Preferred embodiments of the invention are described in detail below with reference to the attached drawing figures, wherein.

Figure 1:
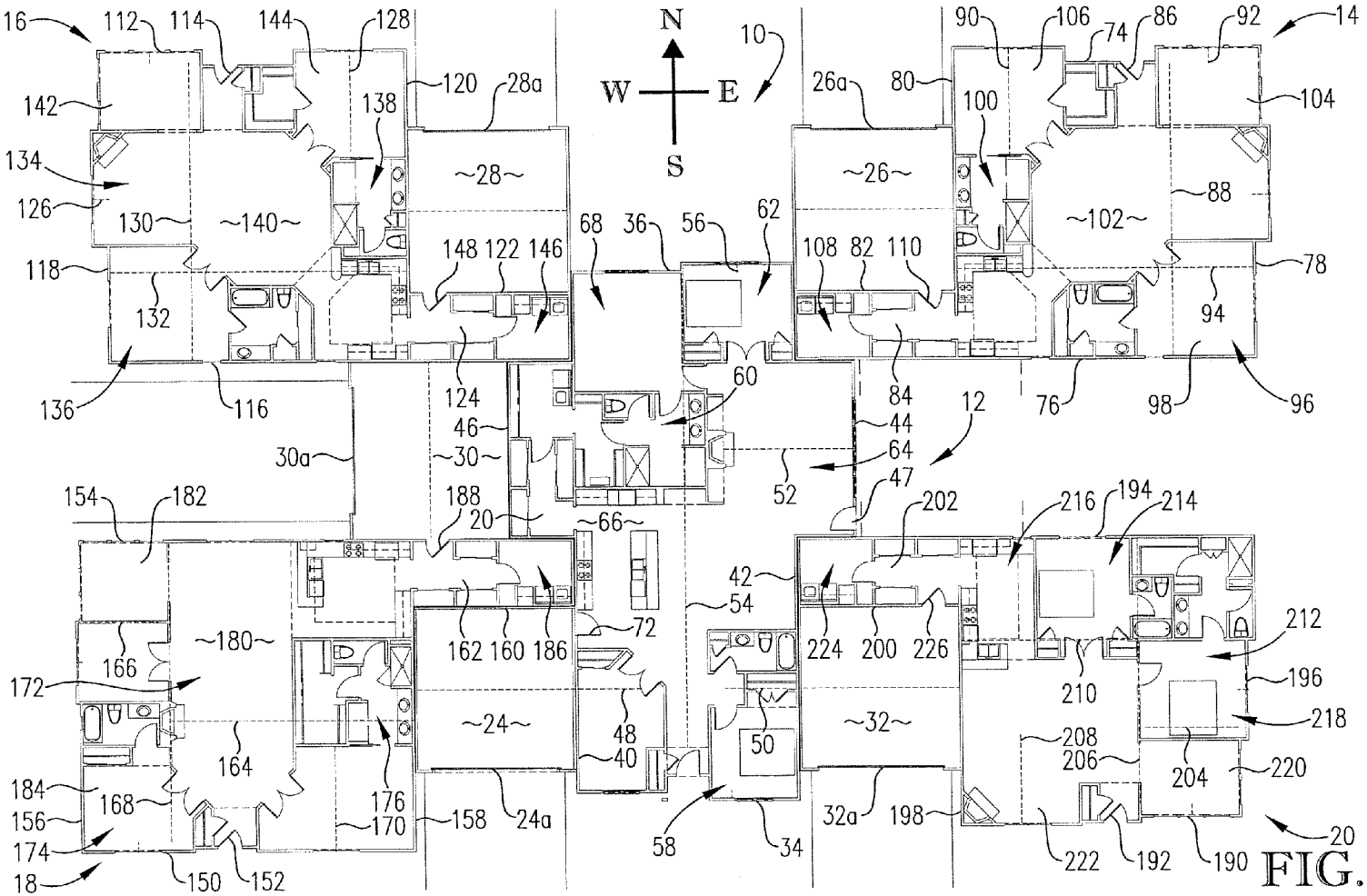
FIG. 1 is a plan view of a preferred multiplex housing constructed in accordance with the principles of the present invention, particularly showing the layout and relative orientation of the housing units within the multiplex.
Figure 2:
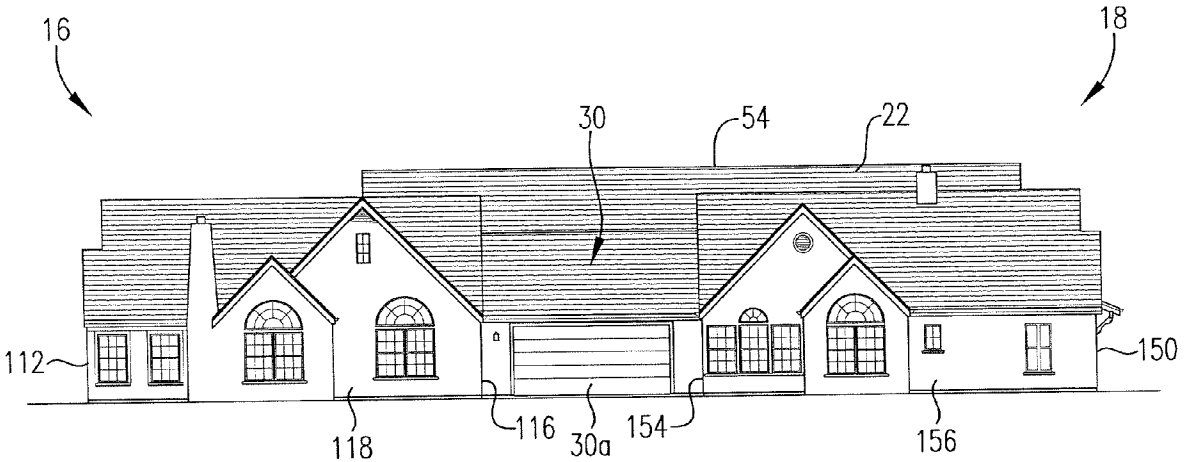
FIG. 2 is an elevational view of the housing unit, viewing a west exposure thereof.

The drawing figures do not limit the present invention to the specific embodiments disclosed and described herein. The drawings are not necessarily to scale, emphasis instead being placed upon clearly illustrating the principles of the invention.

DETAILED DESCRIPTION OF THE PREFERRED EMBODIMENT

Turning now to the drawings, FIG. 1 illustrates a preferred five-plex housing structure 10 broadly comprising interconnected individual housing units including a central unit 12 and four peripheral housing units 14,16,18,20 respectively disposed about the unit 12 in a somewhat "spoke" orientation. Although placement of the overall structures depends upon the site in question, in the illustrated embodiment, the corner units 14,16 face due north. The structure 10 is covered by a common roof 22 presenting individual gables associated with each of the housing units as will be described. In addition, the structure 10 has a total of five garages 24,26,28,30,32 respectively associated with central unit 12 and the peripheral units 14,16,18,20, with each garage having a door 24*a*,26*a*,28*a*,30*a*,32*a*.

In greater detail, the central housing unit 12 is somewhat cruciform-shaped in plan view and includes front and rear exterior walls 34,36, with the former presenting a main entry door 38. Additionally, the unit 12 has sidewalls 40,42,44,46; a secondary entry door 47 is provided in sidewall 44. The portion of roof 22 covering the unit 12 is gabled and presents roof lines 48,50,52,54,56. The interior of central unit 12 includes walls defining a master suite 58, kitchen 60, rear bedroom 62, and multi-purpose rooms 64,66,68,70. The garage 24 is associated with central unit 12, and a doorway 72 is provided between central unit 12 and the garage 24.

Figure 3:
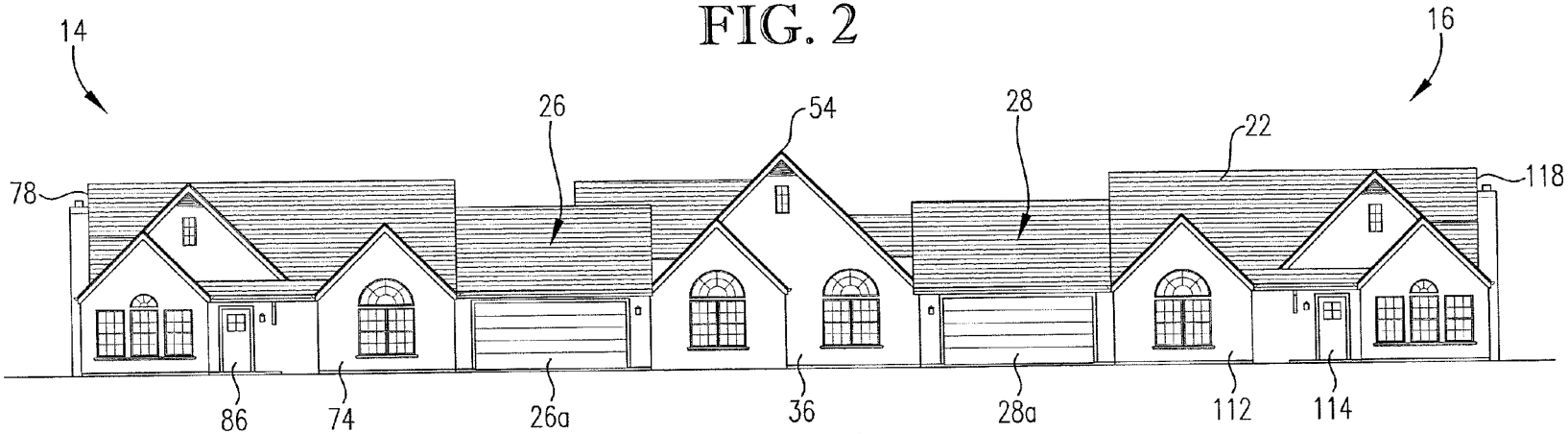
FIG. 3 is an elevational view of the housing unit, viewing a north exposure thereof.
Figure 4:
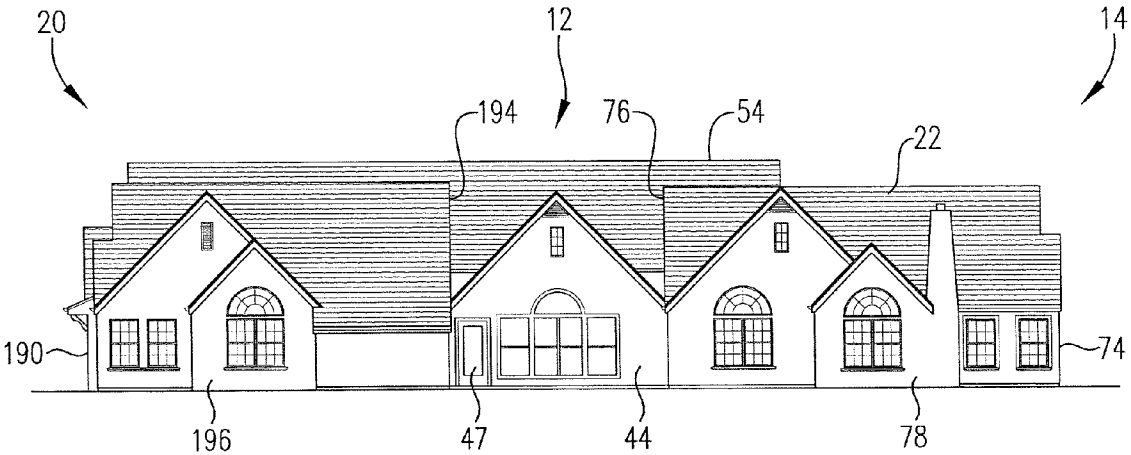
FIG. 4 is an elevational view of the housing unit, viewing an east exposure thereof.
Figure 5:
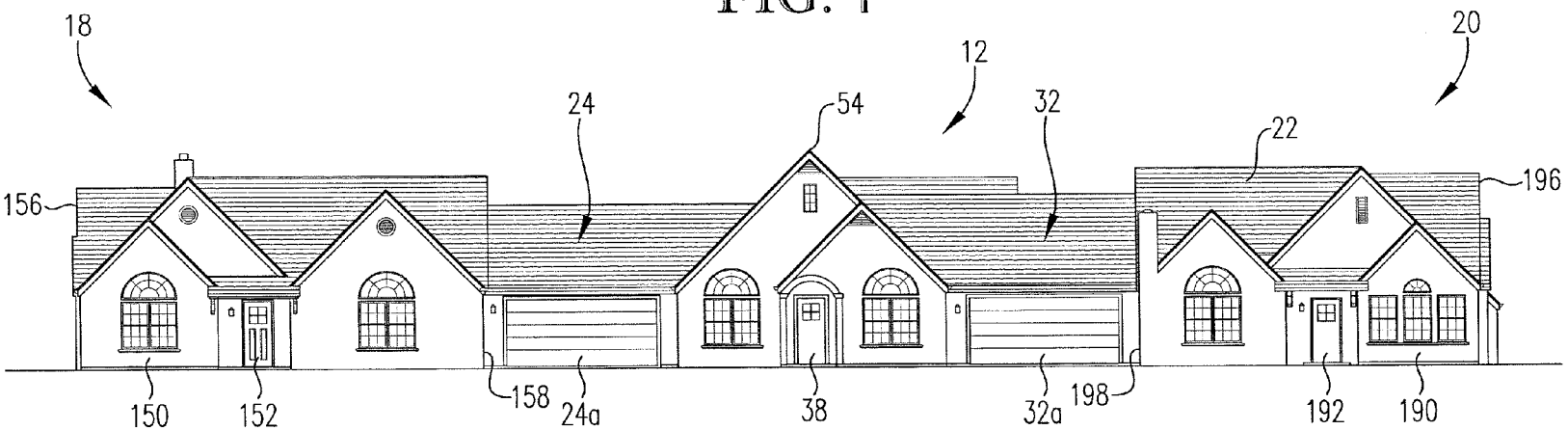
FIG. 5 is an elevational view of the housing unit, viewing a south exposure thereof.

Peripheral unit 14 is located at the northeast corner of the structure 10 as shown in FIG. 1, and includes front and rear walls 74,76, and sidewalls 78,80. It will be noted that the rear wall 76 is of greater length than front wall 74; this added length, together with a corresponding interior wall 82, defines an elongated section 84 which is important for purposes to be described. A main entry door 86 is provided in front wall 74 as best seen in FIG. 3. The portion of roof 22 covering housing unit 14 presents roof lines 88,90,92,94. Referring to FIG. 1, it will be seen that the primary dwelling area 96 of peripheral unit 14 is generally quadrate in plan view configuration and defined by walls 74,76,78,80, with the extension section 84 extending from the primary dwelling area 96 towards central unit 12. The unit 14 has inner walls defining a master suite 98, kitchen 100, and multi-purposes rooms 102,104,106. Preferably, the extension section 84 houses a laundry room 108. The garage 26 is associated with unit 14 via door 110 between the garage 26 and extension section 84.

Peripheral unit 16 is located at the northwest corner of the structure 10 and includes front wall 112, equipped with main entrance door 114, rear wall 116, and sidewalls 118,120. Again, note that rear wall 116 is longer than front wall 114, and defines, with interior wall 122, an elongated extension section 124. The portion of roof 22 over unit 16 presents roof lines 126,128,130,132.

The primary dwelling area 134 of unit 16 is substantially quadrate in plan view and has interior 25 walls defining master suite 136, kitchen 138, and multi-purpose rooms 140,142,144. The extension section 124 may house a laundry room 146. The garage 28 is associated with unit 16 via door 148 communicating the garage and extension section 124.

The peripheral unit 18 is located at the southwest corner of the structure 10 and has exterior walls including front wall 150 having main entry door 152, rear wall 154 and sidewalls 156,158. The wall 154 is greater in length than opposed wall 152, and defines with interior wall 160, an elongated extension section 162. The portion of roof 22 over unit 18 defines roof lines 164,166,168,170. The generally quadrate in plan view primary dwelling area 172 has internal walls defining master suite 174, kitchen 176 and multi-purpose rooms 180,182,184. A laundry room 186 is located within extension section 162. The garage 30 is connected to unit 18 via door 188 communicating the garage and extension section 162.

Finally, peripheral unit 20 is located at the southeast corner of the structure 10 and includes exterior walls, namely front wall 190 equipped with main entry door 192, rear wall 194, and sidewalls 196,198. The rear wall 194 is longer than opposed front wall 190, and defines, with interior wall 200, an elongated extension section 202. The portion of roof 22 covering unit 20 presents roof lines 204,206,208,210.

The generally quadrate in plan view primary dwelling area 212 of unit 20 has interior walls defining master suite 214, kitchen 216, and multi-purpose rooms 218,220,222. A laundry room 224 is located within extension section 202. The garage 32 is associated with unit 20 via door 226 communicating the garage 32 and extension section 202.

The design of housing structure 10 affords a number of advantages and gives extremely efficient land use while at the same time maximizing the privacy factors for each of the respective housing units 12,14,16,18,20. These advantages arise from the concept of a central dwelling unit and four peripheral units disposed about the central dwelling unit in a "spoke" fashion. More particularly, and as described, each of the peripheral dwelling units 14,16,18,20 has a primary dwelling area 96,134,172,212 and an elongated dwelling extension 84,124,162,202 extending from the corresponding primary dwelling area to an exterior wall portion of central unit 12. This construction permits placement of the garages 24,28,26,32 along the length of the respective extension sections, with the final garage 30 located between units 16,18 and facing west. Moreover, it will be seen that the five garages face in a total of three separate directions, i.e., the garages 24,32 face south in the illustrated embodiment, opposed garages 28,26 face 25 north, and fifth garage 30 faces west. Such an arrangement provides greater flexibility in street access and enhances the overall appearance of the structure.

In order to enhance privacy for the residents of the units 12,14,16,18,20, the respective master suites 58,98,136,174, 214 of the units are all located so that one of the garages is interposed between each master suite and the adjacent housing unit.

It will also be appreciated that the individual units can be customized at the discretion of the builder/occupier. Thus, the interior floor plans can be varied essentially at will to create different room combinations and sizes.

However, in the illustrated embodiment, at least some of walls the dwelling units and roofing of the structure are preferably modular. Thus, not only can similar materials be used in different ones of the units, but the structure is highly versatile in the sense that units can be eliminated from the design so as to accommodate for maximum land use within a planned community. In fact, the structure can be provided with any single unit or combination of units.

The preferred forms of the invention described above are to be used as illustration only, and should not be utilized in a limiting sense in interpreting the scope of the present invention. Obvious modifications to the exemplary embodiments, as hereinabove set forth, could be readily made by those skilled in the art without departing from the spirit of the present invention.

The inventor hereby states his intent to rely on the Doctrine of Equivalents to determine and assess the reasonably fair scope of the present invention as pertains to any apparatus not materially departing from but outside the literal scope of the invention as set forth in the following claims.

What is claimed is:

1. A multiplex housing structure comprising:

a central dwelling unit including outer wall segments arranged in a cruciform shape to define four outwardly facing corners that are concave in shape, with each of the corners being defined by at least two corner-defining ones of the outer wall segments; and four peripheral dwelling units disposed about said central dwelling unit, each peripheral dwelling unit having walls defining a primary dwelling area and an elongated dwelling section projecting from the primary dwelling area, each of said elongated dwelling sections having an end remote from the corresponding primary dwelling section, each of said ends being received by a respective one of the corners, with at least one of the walls of each corresponding peripheral dwelling unit forming a common wall with at least one of the corresponding corner-defining outer wall segments, such that the walls defining the primary dwelling area of each peripheral dwelling unit are spaced from the central dwelling unit.

2. The multiplex housing structure of claim 1; and a common roof covering said central and peripheral dwelling units.

3. The multiplex housing structure of claim 1; and a plurality of garages including a central garage and at least one peripheral garage, said central garage being connected to and serving the central dwelling unit, said at least one peripheral garage being connected to and serving a corresponding one of the peripheral dwelling units.

4. The multiplex housing structure of claim 3, said garages and said dwelling units being equal in number.

5. The multiplex housing structure of claim 3, said plurality of garages comprising four garages, said garages and said dwelling units being configured and arranged so that the four garages are respectively located between the central dwelling unit and the at least four peripheral dwellings, each of the four garages bordering one of the defining walls of one of the extension sections and at least part of the defining walls of the corresponding primary dwelling area.

6. The multiplex housing structure of claim 5, two of said four garages being in opposed relationship to the other of the two garages.

7. The multiplex housing structure of claim 5, said plurality of garages including a fifth garage, said garages and said dwelling units being configured and arranged so that the fifth garage is located between a pair of adjacent elongated dwelling sections.

8. The multiplex housing structure of claim 7, said fifth garage being the central garage.

9. The multiplex housing structure of claim 3, said garages facing in at least three separate directions.

10. The multiplex housing structure of claim 9, said walls of each of the peripheral dwelling units comprising at least three exterior walls of the unit that are generally orthogonal to each other.

11. The multiplex housing structure of claim 1, each of said primary dwelling areas being generally quadrate in plan configuration.

12. The multiplex housing structure of claim 1, said walls of each of the peripheral dwelling units comprising at least three exterior walls of the unit that are generally orthogonal to each other.

13. The multiplex housing structure of claim 3, each of said plurality of garages including oppositely spaced sides, with each side extending along a respective one of the dwelling units adjacent thereto.

14. The multiplex housing structure of claim 1, each of said dwelling units including a master suite, with none of the master suites being defined by the respective common wall.

15. The multiplex housing structure of claim 3, said plurality of garages comprising four garages, with each of the peripheral dwelling units being positioned adjacent to a respective one of the four garages, said common wall of each corner being defined along the elongated dwelling section of the respective peripheral dwelling unit and the corresponding one of the four garages.

16. The multiplex housing structure of claim 1, each corner being defined by only two of the corner-defining wall segments that intersect one another at a right angle.

17. The multiplex housing structure of claim 1, said corner-defining outer wall segments and said outer walls defining each of the common walls by extending alongside one another to provide a double-wall construction.

* * * * *